US008764915B2

(12) United States Patent
Katsumata

(10) Patent No.: US 8,764,915 B2
(45) Date of Patent: Jul. 1, 2014

(54) CARBURIZING TREATMENT APPARATUS AND METHOD

(75) Inventor: Kazuhiko Katsumata, Saitama (JP)

(73) Assignee: Ishikawajima-Harima Heavy Industries Co., Ltd. (JP)

( * ) Notice: Subject to any disclaimer, the term of this patent is extended or adjusted under 35 U.S.C. 154(b) by 388 days.

(21) Appl. No.: 11/533,161

(22) Filed: Sep. 19, 2006

(65) Prior Publication Data

US 2007/0062612 A1 Mar. 22, 2007

(30) Foreign Application Priority Data

Sep. 21, 2005 (JP) ..... P2005-273726

(51) Int. Cl.

| | |
|---|---|
| ***C23C 8/00*** | (2006.01) |
| ***C21D 11/00*** | (2006.01) |
| ***C21D 1/74*** | (2006.01) |
| ***C21D 1/06*** | (2006.01) |

(52) U.S. Cl.

USPC ..... 148/215; 266/80; 266/87; 266/90; 266/252

(58) Field of Classification Search

USPC ..... 266/80, 87, 90, 252; 148/215

See application file for complete search history.

(56) References Cited

U.S. PATENT DOCUMENTS

| | | | | |
|---|---|---|---|---|
| 2,698,222 | A | 12/1954 | Davis | |
| 4,118,016 | A | 10/1978 | Westeren et al. | |
| 5,231,645 | A * | 7/1993 | Uno et al. | 373/136 |
| 6,591,215 | B1 | 7/2003 | Blumenthal et al. | |
| 2002/0179187 | A1 | 12/2002 | Ebihara et al. | 148/216 |
| 2003/0020214 | A1 | 1/2003 | Poor et al. | |
| 2004/0187966 | A1 | 9/2004 | Yamaguchi et al. | 148/223 |

FOREIGN PATENT DOCUMENTS

| | | |
|---|---|---|
| CN | 2591770 Y | 12/2003 |
| CN | 1560317 | 1/2005 |
| DE | 101 97 283 | 11/2004 |
| JP | 53-54135 | 5/1978 |
| JP | 62-112726 | 5/1987 |
| JP | 03-110382 | 5/1991 |
| JP | 05-230527 | 9/1993 |
| JP | 05-230555 | 9/1993 |
| JP | 05-271751 | 10/1993 |
| JP | 2002-257479 | 9/2002 |
| JP | 2002-357389 | 12/2002 |
| JP | 2004-027299 | 1/2004 |
| JP | 2004-250782 | 9/2004 |

OTHER PUBLICATIONS

Joseph R. Davis, ASM Handbook-Vacuum Carburizing, 1991, ASM International, 10th Edition, vol. 4, 348.*

(Continued)

*Primary Examiner* — Roy King
*Assistant Examiner* — Caitlin Kiechle
(74) *Attorney, Agent, or Firm* — Ostrolenk Faber LLP

(57) ABSTRACT

In order to provide a further uniform carburizing treatment to an article to be treated, a carburizing treatment apparatus which performs carburizing treatment by heating the article to be treated in a treatment chamber, the inside of which is under reduced pressure and in a carburizing gas atmosphere, includes a temperature measurement means for measuring temperatures in a plurality of regions inside the treatment chamber and a temperature adjustment means for individually adjusting temperatures in the plurality of regions on the basis of measurement results of the temperature measurement means so that the article to be treated is given a uniform carburizing treatment.

3 Claims, 3 Drawing Sheets

(56) References Cited

OTHER PUBLICATIONS

Okabe, S., English translation of JP 62-112726, May 23, 1987, whole document.*
Tenney, A.S., "Temperature Control in Heat Treating-Measurement and Control Instruments", ASM Handbook, 1991, ASM International, vol. 4, p. 1-6.*
Office Action issued on Nov. 25, 2008 in the corresponding French Patent Application No. 0653707.
German Opposition dated Jul. 14, 2009 against German Patent No. 10 2006 044 626 B4 (with English translation).
"Einkammer Vacuum-Technik", Ipsen-Prospect Ipsen International GmbH of Oct. 1996 (with English translation of relevant portions).
DIN 17052-1 "Heat Treatment Furnaces—Part 1: Requirements for Temperature Uniformity" Oct. 2000 (with English translation).
Japanese Office Action, dated Apr. 26, 2011, issued in corresponding Japanese Application No. 2005-273726, with English translation. Total 7 pages.

* cited by examiner

CARBURIZING TREATMENT APPARATUS AND METHOD

BACKGROUND OF THE INVENTION

1. Field of the Invention

The present invention relates to a carburizing treatment apparatus and a carburizing treatment method.

Priority is claimed on Japanese Patent Application No. 2005-273726, filed on Sep. 21, 2005, the content of which is incorporated herein by reference.

2. Description of the Related Art

So-called carburizing treatments, in which an article to be treated composed of metal materials is increased in carbon content within a surface layer in order to quench and harden only the surface layer, are utilized in various treatment processes such as pack carburizing, liquid carburizing, gas carburizing, and vacuum carburizing and the like. Among these processes, the vacuum carburizing is often used in cases where the article to be treated is required be photoluminescent.

Vacuum carburizing is a process by which the article to be treated is increased in carbon content within the surface layer by a process such that, after the inside of a treatment chamber being made vacuum conditions, a slightly decomposed carburizing gas is supplied into the treatment chamber and, while such a state is maintained, the article to be treated is heated.

For example, Patent Document 1 and Patent Document 2 have disclosed a vacuum carburizing furnace by which the above-described vacuum carburizing process is used to provide a carburizing treatment to the article to be treated.

Patent Document 1: Japanese Unexamined Patent Application, First Publication No. 2004-27299

Patent Document 2: Japanese Unexamined Patent Application, First Publication No. 2002-357389

Incidentally, in the above-described vacuum carburizing furnace, how much extent the carburizing treatment is performed on the article to be treated depends on heating temperature, heating time, and temperature retention time and the like of the article to be treated. Therefore, in a case where a desired carburizing treatment is performed on the article to be treated, it is necessary to accurately control temperature inside the treatment chamber.

For this reason, in a conventional vacuum carburizing furnace, temperature inside the treatment chamber is measured by a temperature measurement means such as a thermocouple, thereby controls an output of a heater located inside the treatment chamber based on the measurement results of the temperature measurement means so that a desired temperature environment is attained inside the treatment chamber.

However, in the conventional vacuum carburizing furnace, temperatures are measured only at one spot in the treatment chamber to control the output of the heater on the basis of the measurement result. Therefore, according to a configuration of the article to be treated and variance in a loaded quantity of the article to be treated inside the treatment chamber, there may be a case where a failure in uniformly elevating temperatures of the article to be treated inside the treatment chamber arises.

In this case, variance in carburizing treatment progress is generated in the article to be treated, resulting in failure in providing a uniform carburizing treatment to the article to be treated.

SUMMARY OF THE INVENTION

The present invention has been made in view of the above-described problems, an object of which is to provide a further uniform carburizing treatment to the article to be treated.

In order to attain the above object, a first aspect of the carburizing treatment apparatus according to the present invention is a carburizing treatment apparatus which performs carburizing treatment by heating the article to be treated in a treatment chamber, the inside of which is under reduced pressure and in a carburizing gas atmosphere, which includes a temperature measurement means for measuring temperatures in a plurality of regions inside the treatment chamber and a temperature adjustment means for individually adjusting temperatures in the plurality of regions on the basis of the measurement results of the temperature measurement means so that the article to be treated is provided with a uniform carburizing treatment.

A second aspect of the carburizing treatment apparatus according to the present invention is the carburizing treatment apparatus described in the first aspect of the carburizing treatment apparatus, wherein the plurality of regions include at least a forward region in a direction of carrying the article to be treated toward the treatment chamber, a backward region, and an intermediate region located between the forward region and the backward region.

A third aspect of the carburizing treatment apparatus according to the present invention is the carburizing treatment apparatus described in the first aspect or the second aspect of the carburizing treatment apparatus, wherein the temperature adjustment means is constituted with a heater arranged at each of the plurality of regions and a control means for controlling the heater individually on the basis of the measurement results of the temperature measurement means.

A fourth aspect of the carburizing treatment apparatus according to the present invention is the carburizing treatment apparatus described in the third aspect of the carburizing treatment apparatus, wherein the control means individually controls the heater by using PID values (Control parameters of PID control: Proportional Integral and Derivative Control) depending on a loaded mass of the article to be treated at each of the plurality of regions.

A fifth aspect of the carburizing treatment apparatus according to the present invention is the carburizing treatment apparatus described in the third aspect or the fourth aspect of the carburizing treatment apparatus, wherein the heater is arranged so as to surround the article to be treated at each of the plurality of regions.

An aspect of the carburizing treatment method is a carburizing treatment method for performing carburizing treatment by heating the article to be treated in a treatment chamber, the inside of which is under reduced pressure and in a carburizing gas atmosphere, wherein temperatures in a plurality of regions which are inside the treatment chamber are measured and temperatures in the plurality of the regions are individually controlled on the basis of the measurement results so that the article to be treated can be provided with a uniform carburizing treatment.

According to the carburizing treatment apparatus and the carburizing treatment method of the present invention, temperatures in the plurality of regions inside the treatment chamber are measured in order to individually adjust the temperatures in the plurality of the regions on the basis of the measurement results.

It is, therefore, possible to attain a uniform elevation of temperatures in each of the plurality of regions and prevent a possible fluctuations in temperature of the article to be treated due to regions of the article to be treated because of a configuration of the article to be treated or variance in a loaded quantity of the article to be treated inside the treatment chamber, thereby decreases the time required for elevating temperatures.

Thus, according to the carburizing treatment apparatus and carburizing treatment method of the present invention, it is possible to provide the article to be treated with carburizing treatment with a further uniformity.

DETAILED DESCRIPTION OF THE INVENTION

Hereinafter, an explanation will be made of one embodiment of the carburizing treatment apparatus and the carburizing treatment method of the present invention by referring to drawings. It is to be noted that members are appropriately changed in scale to give them a recognizable dimension in the following drawings.

Figure 1:
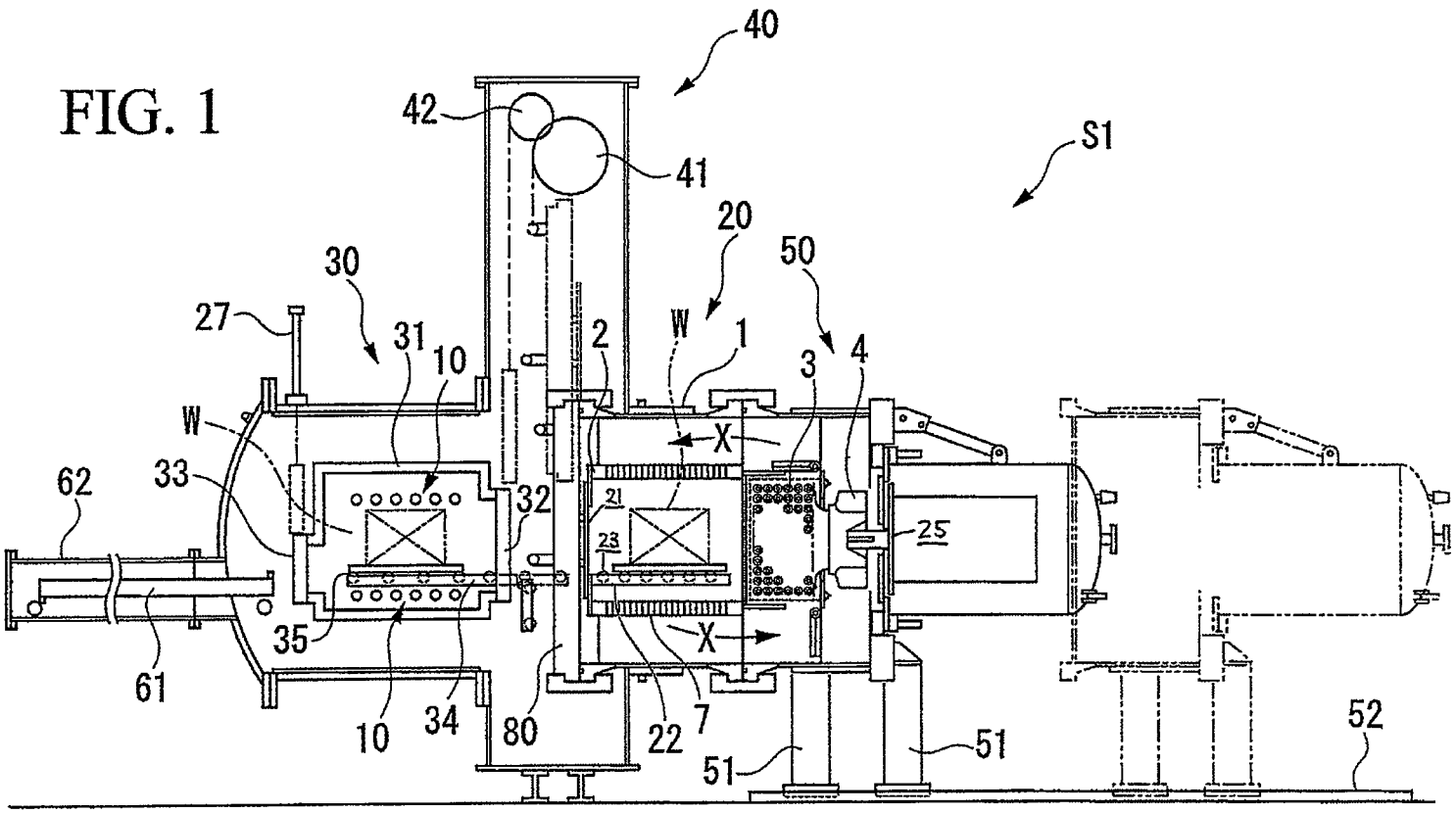
FIG. 1 is a sectional view illustrating a simplified structure of the carburizing apparatus, which is one embodiment of the present invention.

FIG. 1 is a sectional view illustrating a simplified constitution of a carburizing treatment apparatus S1 of the present embodiment. As illustrated in this drawing, the carburizing treatment apparatus S1 of the present embodiment is a multiple-chamber type heat treatment apparatus having a cooling chamber 20 for cooling the article to be treated W and a heating chamber 30 for heating the article to be treated W, and additionally having an intermediate chamber 40 disposed between the cooling chamber 20 and the heating chamber 30.

The cooling chamber 20 is constituted of a heat treatment furnace 1, in which a cooling gas X is circulated, and a wind furnace chamber 2 which is arranged inside the heat treatment furnace 1.

In addition to the wind furnace chamber 2, a heat exchanger 3 for cooling the cooling gas X and a fan 4 for circulating the cooling gas X inside the heat treatment furnace 1 are arranged inside the heat treatment furnace 1.

The heat treatment furnace 1 is shaped approximately in a cylindrical form so as to withstand the pressure even when pressure conditions inside the heat treatment furnace 1 are changed, and is positioned so that the central axis of the cylindrical form is kept horizontal.

Further, one end portion of the heat treatment furnace 1 is constituted as a vacuum shield door 80. The inside of the vacuum shield door 80 is connected to a detachable side wall portion 21 of the wind furnace chamber 2. By opening the vacuum shield door 80, the side wall portion 21 is detached and the article to be treated W can be moved between the cooling chamber 20 and the intermediate chamber 40.

It is to be noted that inside the heat treatment furnace 1, an outer space of the wind furnace chamber 2 is divided into an upper portion and a lower portion by a partition plate (not illustrated). Further, the partition plate supports the wind furnace chamber 2.

The wind furnace chamber 2 is provided so as to heat or cool the article to be treated W inside the chamber. A base 22 for placing the article to be treated W is arranged inside the wind furnace chamber 2, and the base 22 is provided with a plurality of free rollers 23 that allow the article to be treated W to move in and out more easily. Further, the base 22 is structured so as to allow gas to pass through upwardly or downwardly (for example, a lattice structure).

In addition, upper and lower wall portions of the wind furnace chamber 2 are constituted as homogenized rectifier portions 7 (7*a*, 7*b*) for homogenizing and rectifying the flow of the cooling gas X. More specifically, a combination of a lattice box spaced in a lattice form with a punching metal and the like is used as the homogenized rectifier portion 7.

Further, the rear end portion of the cooling chamber 20 (end portion including the heat exchanger 3 and the fan 4) is constituted as a door 50 which can be opened and closed. Then, a side wall portion 25 which is opposed to the side wall portion 21 of the wind furnace chamber 2 and which can also be opened or closed is connected to the door 50, which includes the heat exchanger 3 and the fan 4 and can be opened or closed.

Therefore, by opening the door 50, it is possible to move the article to be treated W between the cooling chamber 20 (wind furnace chamber 2) and outside of the apparatus. The door 50 is supported by a supporting leg 51, and the supporting leg 51 is fixed to a sliding device 52 placed on the ground. When the sliding device 52 is activated, the door 50 is, as illustrated in the drawing, brought closer to or away from the cooling chamber 20 in a horizontal direction. By employing the above-described sliding device 52, it becomes possible to easily open or close the door 50. A mechanism for easily opening or closing the door 50 is not restricted to the sliding device 52 but may include a hinge device or such devices.

The heating chamber 30 is also shaped approximately in a cylindrical form, as with the cooling chamber 20, and arranged so as to be opposed to the cooling chamber 20, as illustrated in the drawing. Further, a carrier bar 61 for carrying the article to be treated W inside the present carburizing treatment apparatus S1 is provided inside a carrier bar accommodating chamber 62 connected to the heating chamber 30.

An insulation chamber 31 (treatment chamber), which is shaped approximately in a rectangular form, is provided inside the heating chamber 30. An insulation door 32 is provided on the side surface on one end of the insulation chamber 31 (the side opposed to the cooling chamber 20), and a carrier bar door 33, which will act as an outlet or an inlet of a carrier bar 61, is provided on the side surface on the other end. The carrier bar door 33 is regulated for opening or closing by an elevating portion 27 mounted so as to project from an outer wall of the heating chamber 30. The carrier bar door 33 is also designed to provide insulation, as is the insulation door 32. A base 34 for placing the article to be treated W is provided inside the insulation chamber 31. The base 34 is shaped in a frame form, for example, so that the article to be treated W can be heated uniformly and is also provided with a free roller 35 for appropriately moving the article to be treated W. Further, the base 34 provided inside the insulation chamber 31 is arranged at the same height as the base 22 provided inside the wind furnace chamber 2.

Figure 2:
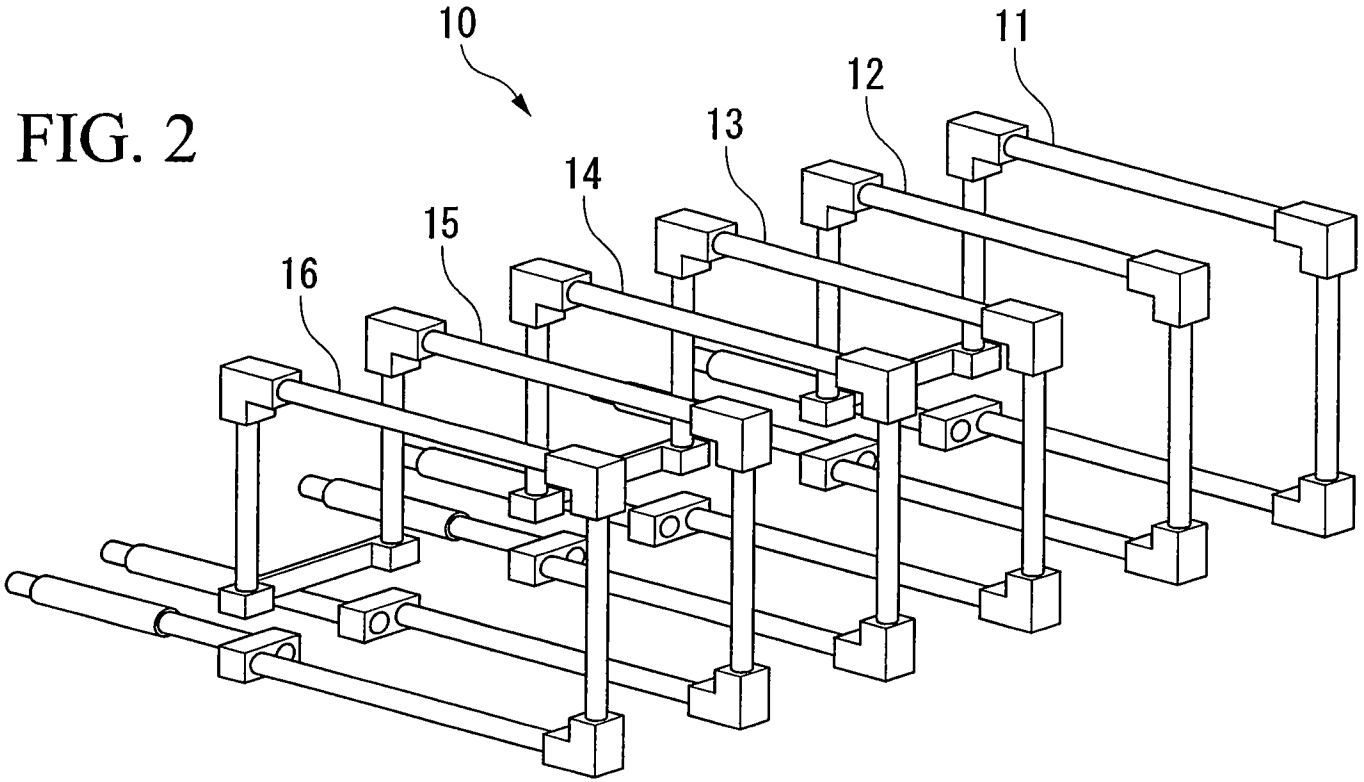
FIG. 2 is a perspective view of a heater.
Figure 3:
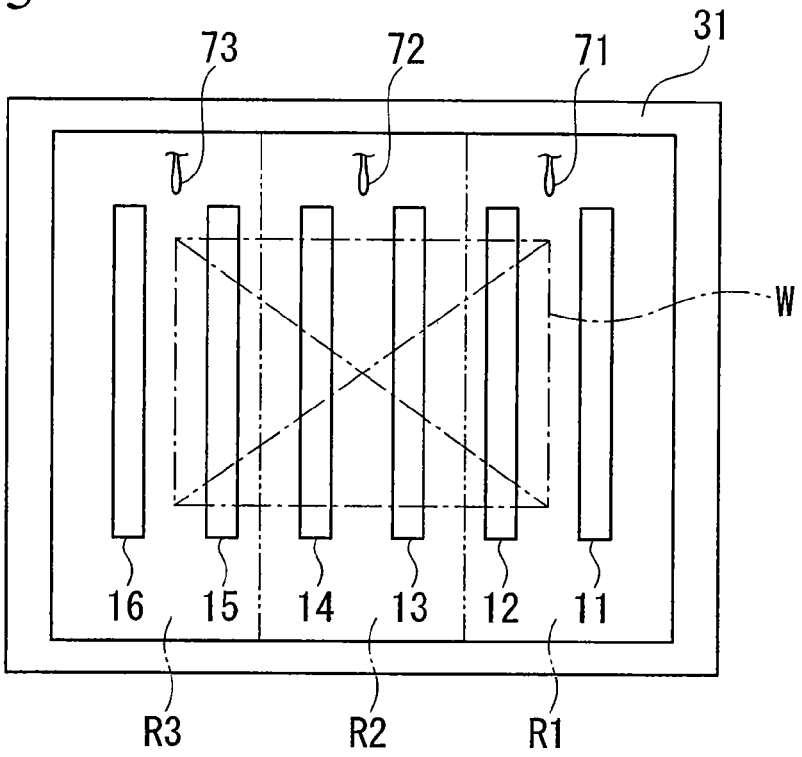
FIG. 3 is an enlarged sectional view schematically illustrating an insulation chamber.

Further, a plurality of heaters 10 for heating the article to be treated W are provided inside the insulation chamber 31. FIG. 2 is a perspective view of the heater 10 and FIG. 3 is an enlarged sectional view schematically illustrating the insulation chamber 31. As illustrated in these drawings, the heaters 10 of the present embodiment are composed of a total of 6 heaters, 11 to 16; namely, heaters 11 and 12, which are arranged at a forward region R1, which is an outlet and inlet side of the insulation chamber 31 (forward region in a direction of moving the article to be treated W therein), heaters 13 and 14 arranged at an intermediate region R2 of the insulation chamber 31 (a region between the forward region and the backward region in a direction of moving the article to be treated W therein), and heaters 15 and 16 arranged at a backward region R3, which is a rear region of the insulation chamber 31 (backward region in a direction of moving the article W to be treated therein). As illustrated in FIG. 2, each of these heaters, 11 to 16, is arranged so as to surround the article to be treated W.

Still further, a thermocouple 71 for measuring temperatures at the forward region R1, a thermocouple 72 for measuring temperatures at the intermediate region R2, and a thermocouple 73 for measuring temperatures at the backward region R3 are arranged inside the insulation chamber 31.

Figure 4:
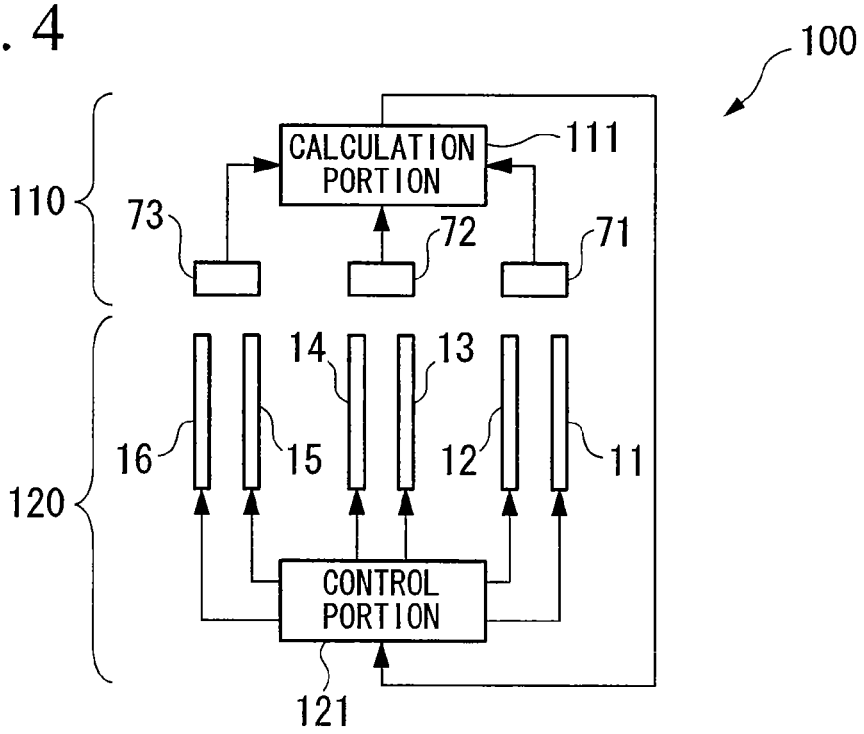
FIG. 4 is a block diagram illustrating the functional constitution of a temperature adjustment system.

FIG. 4 is a block diagram illustrating the functional constitution of a temperature adjustment system 100 in the carburizing treatment apparatus S1 of the present embodiment. As illustrated in the drawing, the above-described heaters, 11 to 16, and the thermocouples, 71 to 73, are included as components of the temperature adjustment system 100. More specifically, the temperature adjustment system 100 is provided with a measurement system 110 for measuring temperatures at the regions R1 to R3 (forward region R1, intermediate region R2, and backward region R3), which are a plurality of regions inside the insulation chamber 31, and an adjustment system 120 for individually adjusting temperatures at the regions R1 to R3 on the basis of the measurement results of the measurement system 110, so that the article to be treated W is provided with a uniform carburizing treatment. Then, the measurement system 110 is provided with thermocouples, 71 to 73, and a calculation portion 111 for calculating the measurement results of the thermocouples 71 to 73 as measured values. Further, the adjustment system 120 is provided with heaters, 11 to 16, and a control portion 121 for adjusting outputs of the heaters, 11 to 16, on the basis of predetermined PID values and measured values input from the measurement system 110.

Then, in the carburizing treatment apparatus S1 of the present embodiment, the control portion 121 adjusts outputs of the heaters 11 and 12 arranged at the forward region R1 on the basis of the measurement results of the thermocouple 71, outputs of the heaters 13 and 14 arranged at the intermediate region R2 on the basis of the measurement results of the thermocouple 72, and outputs of the heaters 15 and 16 arranged at the backward region R3 on the basis of the measurement results of the thermocouple 72.

In other words, in the carburizing treatment apparatus S1 of the present embodiment, temperatures at each of the regions R1 to R3 are measured individually, and temperatures in each of the regions are individually adjusted according to these individually measured results.

More specifically, in the carburizing treatment apparatus S1 of the present embodiment, temperatures in each of the regions R1 to R3 are individually adjusted so that the regions R1 to R3 are uniformly heated.

Further, in the carburizing treatment apparatus S1 of the present embodiment, it is possible to set PID values into the control portion 121 according to the mass of the article to be treated W which is to be loaded at the region concerned. Therefore, the output of heaters, 11 to 16, at each of the regions R1 to R3 can be adjusted on the basis of PID values according to the mass of the article to be treated W which is to be loaded at each of the regions R1 to R3.

Returning to FIG. 1, the intermediate chamber 40 is shaped approximately in a hollow rectangular form and arranged between the cooling chamber 20 and the heating chamber 30. A shield door elevating portion 41 for elevating the vacuum shield door 80 and an insulation door elevating portion 42 for elevating the insulation door 32 are provided in the upper portion of the intermediate chamber 40.

The carburizing treatment apparatus S1 is also provided with a pressure reducing device (not illustrated) for reducing the pressure inside the heating chamber 30 and a carburizing gas supplier (not illustrated) for supplying a carburizing gas (such as acetylene gas) into the insulation chamber 31.

Next, an explanation will be given of the operation (carburizing treatment process) of the above-constituted carburizing treatment apparatus of the present invention.

First, while the sliding device 52 is employed to keep the door 50 separated from the cooling chamber 20, the article to be treated W is placed on the base 22 inside the wind furnace chamber 2. Then, the sliding device 52 is employed to bring the door 50 into contact with the cooling chamber 20, thereby seals the cooling chamber 20. Thereafter, a pressure reducing device (not illustrated) is activated so as to draw a vacuum into the cooling chamber 20, the heating chamber 30, and the intermediate chamber 40. Then, the elevating portion 27, the vacuum shield door elevating portion 41, and the insulation door elevating portion 42 are activated, thereby opens the carrier bar door 33, the vacuum shield door 80, and the insulation door 32.

In this instance, the article to be treated W is moved by the carrier bar 61 onto the base 34 inside the insulation chamber 31 from the base 22 inside the wind furnace chamber 2. The elevating portion 27 and the insulation door elevating portion 42 are then again activated so as to close the carrier bar door 33 and the insulation door 32. The article to be treated W is heated by the heater 10, while maintaining the same state.

Then, in the carburizing treatment apparatus S1 of the present embodiment, temperatures at each of the regions R1 to R3 inside the insulation chamber 31 are individually measured by the temperature adjustment system 100, and temperatures at each of the regions R1 to R3 are individually controlled on the basis of the measurement results so that the article to be treated W is provided with a uniform carburizing treatment.

More specifically, temperatures at the forward region R1 are measured by the thermocouple 71 of the temperature measurement system 110, which constitutes a part of the temperature adjustment system, and the calculation portion 1 of the measurement system 110 calculates and outputs measured values on the basis of the measurement results. Further, temperatures at the intermediate region R2 are measured by the thermocouple 72 of the temperature measurement system 110, and the calculation portion 111 of the measurement system 110 calculates and outputs measured values on the basis of the measurement results. Still further, temperatures at the backward region R3 are measured by the thermocouple 73 of the temperature measurement system 110, and the calculation portion 111 of the measurement system 110 calculates and outputs measured values on the basis of the measurement results.

In other words, the temperature measurement system 110 measures temperatures at a plurality of the regions inside the insulation chamber 31.

Then, measured values obtained by the temperature measurement system 110 are input into the adjustment system 120 which constitutes a part of the temperature adjustment system 100. In this instance, the control portion 121 of the adjustment system 120 adjusts outputs of heaters, 11 to 16, according to measured values which are input. More specifically, the control portion 121 adjusts outputs of the heaters 11 and 12 when measured values based on temperatures at the forward region R1 are input, it adjusts outputs of the heaters 13 and 14 when measured values based on temperatures at the intermediate region R2 are input, and it adjusts outputs of the heaters 15 and 16 when measured values based on temperatures at the backward region R3 are input.

As described so far, the carburizing treatment apparatus S1 of the present embodiment is controlled by the temperature adjustment system 100 so that temperatures are all the same at the regions R1 to R3. Then, when the article to be treated W that is placed inside the insulation chamber 31 is heated up to a predetermined temperature, the carburizing gas is supplied into the insulation chamber 31 by the carburizing gas supplier (not illustrated).

In this instance, in the carburizing treatment apparatus S1 of the present embodiment, since temperatures are controlled so as to be the same at the regions R1 to R3 by the temperature adjustment system 100, the article to be treated W is uniformly heated. Therefore, by supplying the carburizing gas into the insulation chamber 31, it is possible to give a uniform carburizing treatment to the article to be treated W.

Further, in the carburizing treatment apparatus S1 of the present embodiment, it is possible to set PID values into the control portion 121 according to the mass of the article to be treated W which is to be loaded in the region concerned. When the mass of the article to be treated W, which is to be loaded at each of the regions R1 to R3, is known in advance, it is possible to adjust outputs of the heaters, 11 to 16, at each of the regions R1 to R3 on the basis of PID values according to the mass of the article to be treated W, which is to be loaded into each of the regions R1 to R3, namely, PID values according to the endothermic capacity of the article to be treated W which exists at each of the regions R1 to R3. Therefore, even in a case where temperatures inside the insulation chamber 31 are changed during carburizing treatment, it is possible to alter to the same temperature at the same speed the article to be treated W which exists at each of the regions R1 to R3, thereby making it possible to provide a further uniform carburizing treatment.

Upon completion of carburizing treatment of the article to be treated W, the carburizing gas inside the heating chamber 30 (insulation chamber 31) is discharged again by a pressure reducing device, and diffusion is conducted for a predetermined time, by which cementite generated by the carburizing treatment is diffused. Thereafter, the carrier bar door 33 and the insulation door 32 are opened, and the article to be treated W is again moved to the base 22 inside the wind furnace chamber 2 by the carrier bar 61. Then, when the article to be treated W is moved to the base 22 of the wind furnace chamber 2, the vacuum shield door 80 is sealed.

Then, the cooling gas X cooled by the heat exchanger 3 is circulated by the fan 4, and the flow of the circulated cooling gas X is homogenized by the homogenized rectifier portion 7. The thus homogenized cooling gas X is sprayed onto the article to be treated W, whereby the article to be treated W is cooled uniformly.

Then, when the article to be treated W is cooled down to a predetermined temperature, the door 50 is removed from the cooling chamber 20, and the article to be treated W is moved outside.

According to the carburizing treatment apparatus and carburizing treatment method described in the present embodiment, temperatures in each of the regions R1 to R3 inside the insulation chamber 31 are measured individually, and temperatures in each of the regions R1 to R3 are individually controlled on the basis of the measurement results so that the article to be treated W is provided with a uniform carburizing treatment. It is, therefore, possible to attain a uniform elevation of temperatures of the article to be treated W as a whole. Even in a case where a highly carburizing gas such as acetylene gas is used, the article to be treated W can be provided with a further uniform carburizing treatment.

An explanation has been so far made of preferred embodiments of the carburizing treatment apparatus and the carburizing treatment method of the present invention by referring to the attached drawings. As a matter of course, the present invention shall not be restricted to the above-described embodiments. Various configurations and combinations of components given in the embodiments are only one example, and may be available in various modifications on the basis of design requirements and others as long as they do not deviate from the gist of the present invention.

In the above-described embodiment, the cooling gas is used to cool the article to be treated W. The present invention shall not be restricted thereto, but, for example, a cooling oil may be used to cool the article to be treated W.

Further, the carburizing treatment apparatus S1 of the above-described embodiment is provided with the heating chamber 30, the cooling chamber 20, and the intermediate chamber 40 provided between them. However, the present invention shall not be restricted thereto, but may be applicable to the carburizing treatment apparatus S1 provided with a plurality of heating chambers 30 or with a treatment chamber in which another treatment is given to the article to be treated W.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A carburizing treatment method of a carburizing treatment apparatus for performing a uniform carburizing treatment by heating an article to be treated in a treatment chamber, the treatment chamber having an inside under reduced pressure and containing a carburizing gas atmosphere, wherein the carburizing treatment apparatus comprises:

a temperature measurement device configured to measure temperatures in a plurality of regions in the treatment chamber, and a temperature adjustment device configured to individually control the plurality of regions based on the temperature measurement results obtained by the temperature measurement device;

the plurality of regions includes a forward region in a direction the article to be treated is carried toward in the treatment chamber, a backward region, and an intermediate region positioned between the forward region and the backward region;

the plurality of regions is sized and positioned such that while the article to be treated is stopped in the treatment chamber, the article to be treated is located in each region of the plurality of the regions;

the forward region, the intermediate region and the backward region each includes a plurality of heaters;

the plurality of heaters is positioned inside the treatment chamber so as to surround the article to be treated both from above the article to be treated and below the article to be treated in at least one of the plurality of the regions, and wherein the carburizing treatment method comprises:

a step for individually measuring temperatures in the treatment chamber of the forward region, the intermediate region and the backward region by the temperature measurement device, and a step for individually adjusting the temperatures of the forward region, the intermediate region and the backward region by adjusting temperatures of the plurality of heaters with the temperature adjustment device based on a measurement result of the temperature measurement device by using PID values, the PID value depending on a loaded mass of the article to be treated at each of the plurality of regions so that the article to be treated inside the treatment chamber is provided with the uniform carburizing treatment.

2. A carburizing treatment apparatus for performing a uniform carburizing treatment by heating an article to be treated in a treatment chamber, the treatment chamber including an inside under reduced pressure in a carburizing gas atmosphere, the apparatus comprising:

a temperature measurement device configured to measure temperatures in a plurality of regions in the treatment chamber; and a temperature adjustment device configured to individually control the temperature of the plurality of regions by using PID values depending on a loaded mass of the article to be treated at each of the plurality of regions based on the temperature measurement results obtained by the temperature measurement device, wherein the plurality of regions includes a forward region in a direction the article to be treated is carried toward the treatment chamber, a backward region, and an intermediate region positioned between the forward region and the backward region;

the plurality of regions is sized and positioned such that while the article to be treated is stopped in the treatment chamber, the article to be treated is located in each region of the plurality of the regions;

the forward region, the intermediate region and the backward region each includes a plurality of heaters;

the plurality of heaters is positioned inside the treatment chamber so as to surround the article to be treated both from above the article to be treated and below the article to be treated in at least one of the plurality of the regions;

the temperature measurement device is distant from each of the plurality of heaters; and in the treatment chamber, temperatures of the forward region, the intermediate region and the backward region are individually measured by the temperature measurement device, and the temperatures of the forward region, the intermediate region and the backward region are individually adjusted by adjusting outputs of the plurality of heaters adjusted by the temperature adjustment device based on a measurement result of the temperature measurement device.

3. The carburizing treatment apparatus according to claim 1, wherein the temperature adjustment device comprises a control device for individually controlling each of the heaters based on the basis of the measurement results obtained by the temperature measurement device.

* * * * *